US009546443B2

(12) United States Patent
Lee et al.

(10) Patent No.: US 9,546,443 B2
(45) Date of Patent: Jan. 17, 2017

(54) WASHING MACHINE AND CONTROL METHOD THEREOF

(75) Inventors: Dong Soo Lee, Seoul (KR); Chang Oh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1272 days.

(21) Appl. No.: 13/417,562

(22) Filed: Mar. 12, 2012

(65) Prior Publication Data

US 2012/0192362 A1 Aug. 2, 2012

Related U.S. Application Data

(63) Continuation of application No. PCT/KR2011/001599, filed on Mar. 8, 2011.

(30) Foreign Application Priority Data

Mar. 15, 2010 (KR) ..... 10-2010-0022705
Mar. 15, 2010 (KR) ..... 10-2010-0022706

(51) Int. Cl.

| | |
|---|---|
| ***D06F 37/12*** | (2006.01) |
| ***D06F 37/22*** | (2006.01) |
| ***D06F 37/20*** | (2006.01) |
| ***D06F 33/02*** | (2006.01) |

(52) U.S. Cl.

CPC ..... *D06F 37/225* (2013.01); *D06F 33/02* (2013.01); *D06F 37/203* (2013.01); *D06F 2202/10* (2013.01); *D06F 2222/00* (2013.01)

(58) Field of Classification Search

None

See application file for complete search history.

(56) References Cited

FOREIGN PATENT DOCUMENTS

| | | | | |
|---|---|---|---|---|
| CN | 101130923 | A | 2/2008 | |
| EP | 0 924 330 | A1 | 6/1999 | |
| EP | 0924330 | A1 * | 6/1999 | ..... D06F 37/225 |
| EP | 2 119 820 | A1 | 11/2009 | |
| JP | 10-192586 | A | 7/1998 | |
| JP | 2003-062376 | A | 3/2003 | |
| JP | 2005-021505 | A1 | 1/2005 | |
| KR | 10-1996-0014281 | A | 10/1996 | |
| KR | 10-0111138 | B1 | 1/1997 | |
| KR | 10-1999-0000874 | A | 1/1999 | |
| KR | 10-1999-000874 | A | 1/1999 | |
| KR | 10-1999-0032783 | A | 5/1999 | |
| WO | WO 99/23397 | A1 | 5/1999 | |

OTHER PUBLICATIONS

English machine translation of EP0924330A1.*
English machine translation of KR10-2006-0088720.*
International Search Report dated Sep. 21, 2011 issued in Application No. PCT/KR2011/001599.
European Search Report dated Dec. 20, 2013 issued in Application No. 11 75 6515.

* cited by examiner

*Primary Examiner* — Michael Barr
*Assistant Examiner* — Jason Riggleman
(74) *Attorney, Agent, or Firm* — KED & Associates, LLP

(57) ABSTRACT

Disclosed are a washing machine and a control method thereof. The control method of the washing machine, including two or more balancing units which are independently movable, includes sensing the weight of laundry to be washed while identically maintaining a phase difference between the two or more balancing units and rotating a drum, and reducing eccentricity of the drum while moving at least one of the two or more balancing units simultaneously with rotation of the drum.

15 Claims, 9 Drawing Sheets

WASHING MACHINE AND CONTROL METHOD THEREOF

CROSS-REFERENCE TO RELATED APPLICATION(S)

This application is a continuation of PCT Application No. PCT/KR2011/001599 filed on Mar. 8, 2011, which claims priority to Korean Application Nos. 10-2010-0022705 filed on Mar. 15, 2010 in Korea and 10-2010-0022706 filed on Mar. 15, 2010 in Korea, the entirety of which are herein incorporated by reference.

TECHNICAL FIELD

The present invention relates to a washing machine and a control method thereof.

BACKGROUND ART

In general, a washing machine treats laundry to be washed by rotating a drum accommodating the laundry. As the drum is rotated, vibration and noise of the washing machine occur, and particularly, vibration and noise of the washing machine becomes serious in a spin-drying cycle in which the drum is rotated at a high velocity.

DISCLOSURE

Technical Problem

An object of the present invention is to provide a washing machine which reduces noise and vibration generated from the washing machine according to rotation of a drum.

Technical Solution

The object of the present invention can be achieved by providing a control method of a washing machine having two or more balancing units which are independently movable, the control method including identically maintaining a phase difference between the two or more balancing units, and sensing the weight of laundry to be washed while rotating a drum, and reducing eccentricity of the drum while moving at least one of the two or more balancing units simultaneously with rotation of the drum.

Advantageous Effects

A washing machine in accordance with one embodiment of the present invention may reduce vibration and noise of the washing machine using a balancer which is simple and light as compared to conventional balancers.

The effects of the present invention are not limited to the above-described effects and other effects which are not described herein will become apparent to those skilled in the art from the following description.

DESCRIPTION OF DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE

Hereinafter, washing machines in accordance with embodiments will be described with reference to the accompanying drawings.

Figure 1:
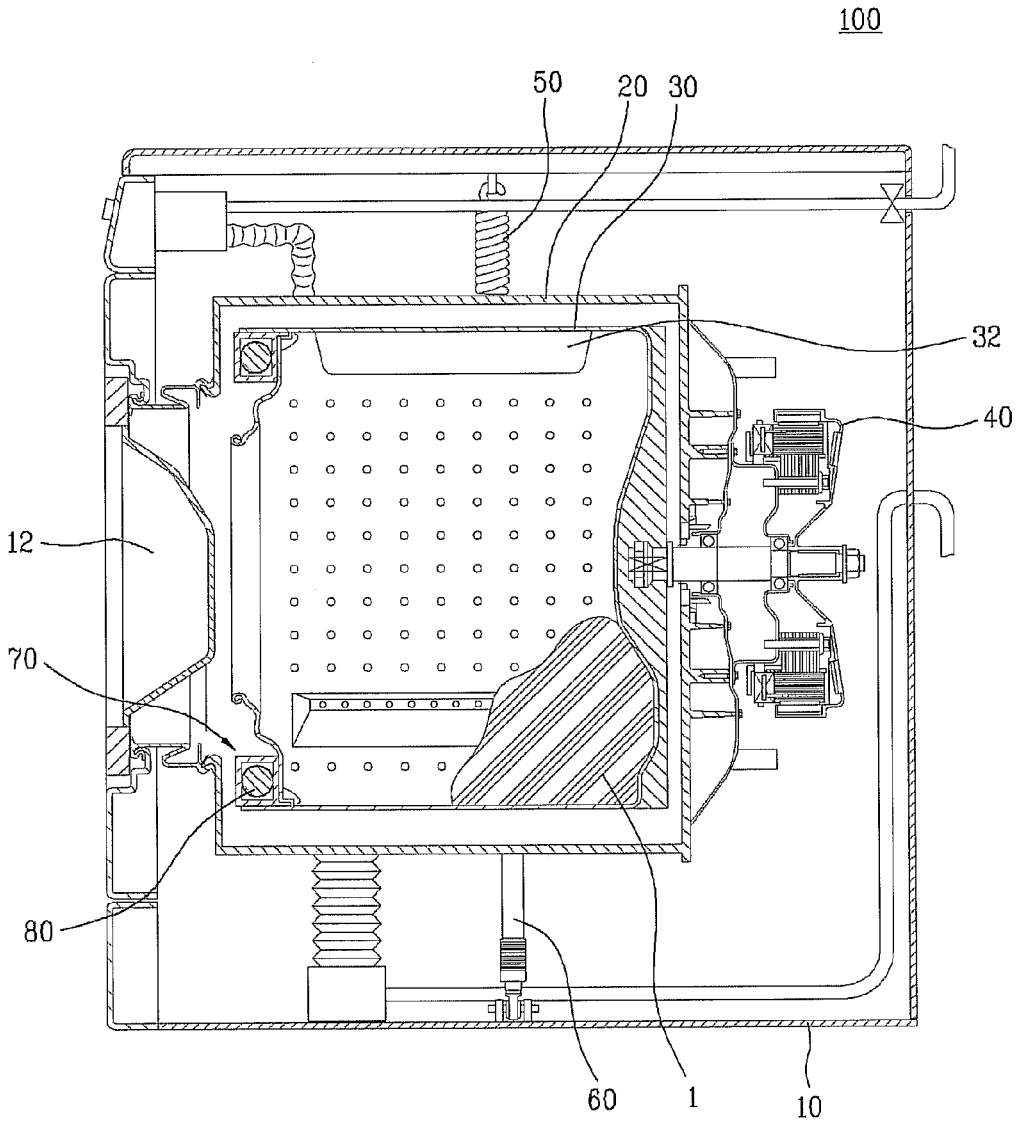
FIG. 1 is a sectional view of a washing machine having a balancer in accordance with one embodiment.

FIG. 1 is a sectional view illustrating a washing machine in accordance with one embodiment.

With reference to FIG. 1, a washing machine 100 includes a cabinet 10 forming the external appearance of the washing machine 100, a tub 20 provided within the cabinet 10 to accommodate wash water, and a drum 30 rotatably provided within the tub 20.

The cabinet 10 forms the external appearance of the washing machine 100, and various elements which will be described later may be mounted in the cabinet 10. First, a door 12 may be provided in front of the cabinet 10. A user may open the door 12 to place laundry to be washed into the cabinet 10.

The tub 20 to accommodate wash water may be provided within the cabinet 10, and the drum 20 to accommodate the laundry to be washed may be rotatably provided within the tub 20. Further, a plurality of lifters 32 to raise the laundry to be washed and then fall the laundry during rotation of the drum 30 may be provided on the inner surface of the drum 30. The lifters 32 raise the laundry to be washed and then fall the laundry to be washed if the drum 30 is rotated, thereby improving washing performance of the washing machine 100. The plural lifters 32 may be provided. For example, although the washing machine 100 in accordance with this embodiment is described as including three lifters 32 on the inner surface of the drum 30, the number of the lifters 32 is not limited thereto.

The tub 20 may be elastically supported by an upper spring 50 and a lower damper 60. When the drum 30 is rotated, the spring 50 and the damper 60 absorb vibration of the drum 30 so as not to transmit such vibration to the cabinet 10. Further, a drive unit 40 to rotate the drum 30 may be mounted on the rear surface of the tub 20. The drive unit 40 may be a motor, and rotate the drum 30. The drive unit 40 is well known to those skilled in the art, and a detailed description thereof will thus be omitted.

If the laundry 1 to be washed is accommodated within the drum 30 when the drum 30 is rotated, as shown in FIG. 1, there is possibility that great noise and vibration are generated according to the position of the laundry 1. That is, when the drum 30 is rotated (hereinafter, referred to as 'eccentrically rotated') if the laundry 1 is not uniformly distributed within the drum 30 but is concentrated into a region, great noise and vibration of the rotated drum 30 may be generated due to non-uniform distribution of the laundry 1. Therefore, in order to prevent vibration and noise due to eccentric rotation of the drum 30, the drum 30 may be provided with a balancer 70.

The balancer 70 is provided on the rotating drum 30. Here, the balancer 70 may be provided on at least one of the front portion and the rear portion of the drum 30. Although FIG. 1 illustrates the balancer 70 as being provided on the front portion of the drum 30, the position of the balancer 70 is not limited thereto.

The balancer 70 is provided on the rotating drum 30 and serves to prevent noise and vibration, and may thus be configured such that the center of gravity of the balancer 70 is varied. That is, the balancer 70 may include mass bodies 80 having a designated weight and installed therein, and a path along which the mass bodies 80 are movable in the circumferential direction. Therefore, if load of the laundry to be washed is concentrated into one side of the drum 30, the mass bodies 80 within the balancer 70 move to the side opposite to the side into which the load is concentrated, and thus prevents noise and vibration due to eccentric rotation of the drum 30.

Here, the balancer 70 may be a liquid balancer including a liquid having a designated weight provided therein, or a ball balancer including balls having a designated weight. Although the washing machine 100 in accordance with this embodiment employs the balancer 70 including balls and a filling fluid provided therein, the present invention is not limited thereto.

Figure 2:
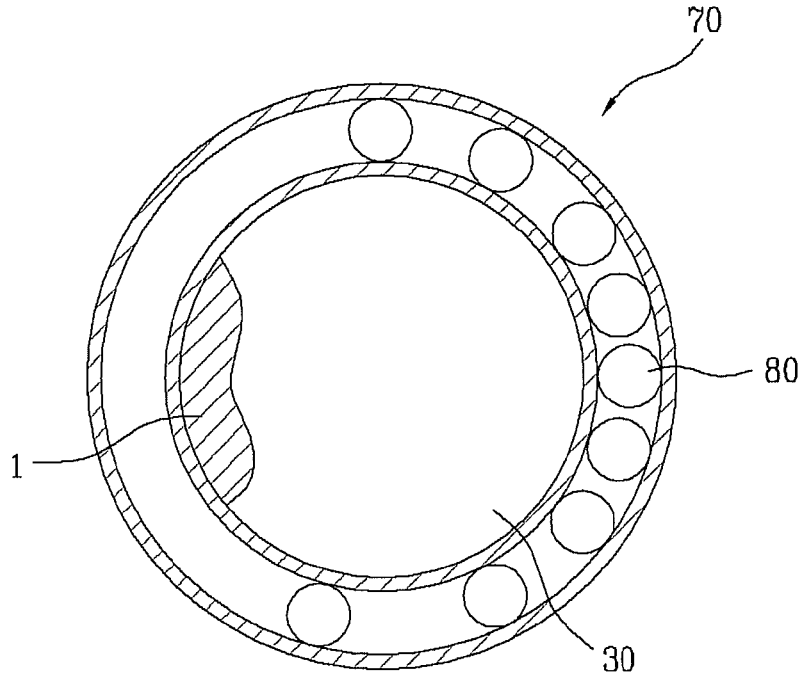
FIG. 2 is a schematic view illustrating the balancer of FIG. 1 in an non-stabilized state.
Figure 3:
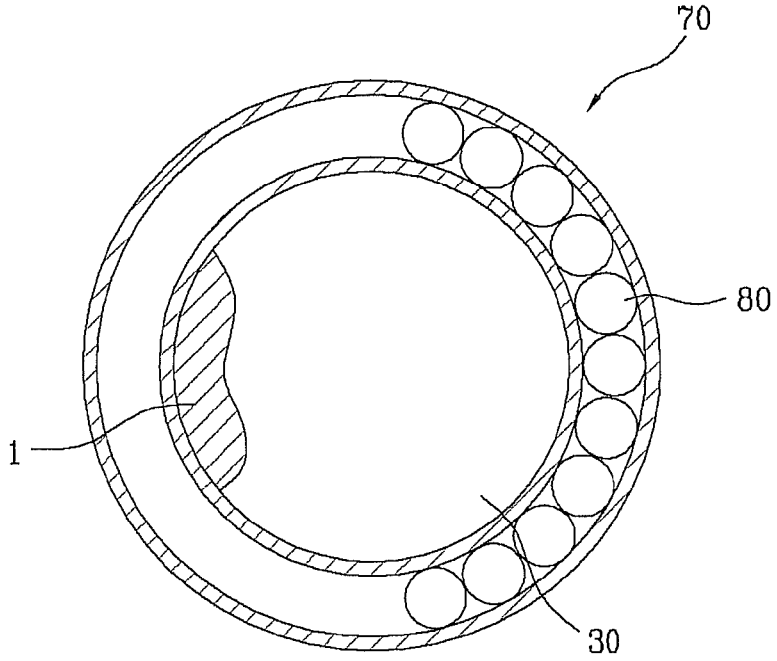
FIG. 3 is a schematic view illustrating the balancer of FIG. 1 in a stabilized state.

FIGS. 2 and 3 are views illustrating movement of balls 80 within the balancer 70 during rotation of the drum.

As shown in FIG. 2, if the drum 30 is rotated, particularly, if the drum 30 is rotated at a high velocity in the spin-drying cycle, the balls 80 within the balancer 70 start to slowly move to the position opposite to the position of the laundry 1 within the drum 30. When a designated time has elapsed, the balls 80 having started to move are located at the position approximately opposite to the laundry 1, as shown in FIG. 3. That is, when the laundry 1 is concentrated into a region and thus eccentricity occurs, the balls 80 of the balancer 70 are collected into the position opposite to the laundry 1 and thus reduce eccentricity. That is, if the drum 30 is rotated at a high velocity, when the balls 80 are collected into the position opposite to the region in which the laundry is concentrated, the balls 80 may prevent eccentric rotation of the drum 30, thereby preventing noise and vibration due to eccentric rotation. Noise and vibration of the washing machine may be generated if the drum 30 is rotated, particularly in the spin-drying cycle in which the drum 30 is rotated at a high velocity. Hereinafter, driving of the drum 30 in the spin-drying cycle will be described.

Figure 4:
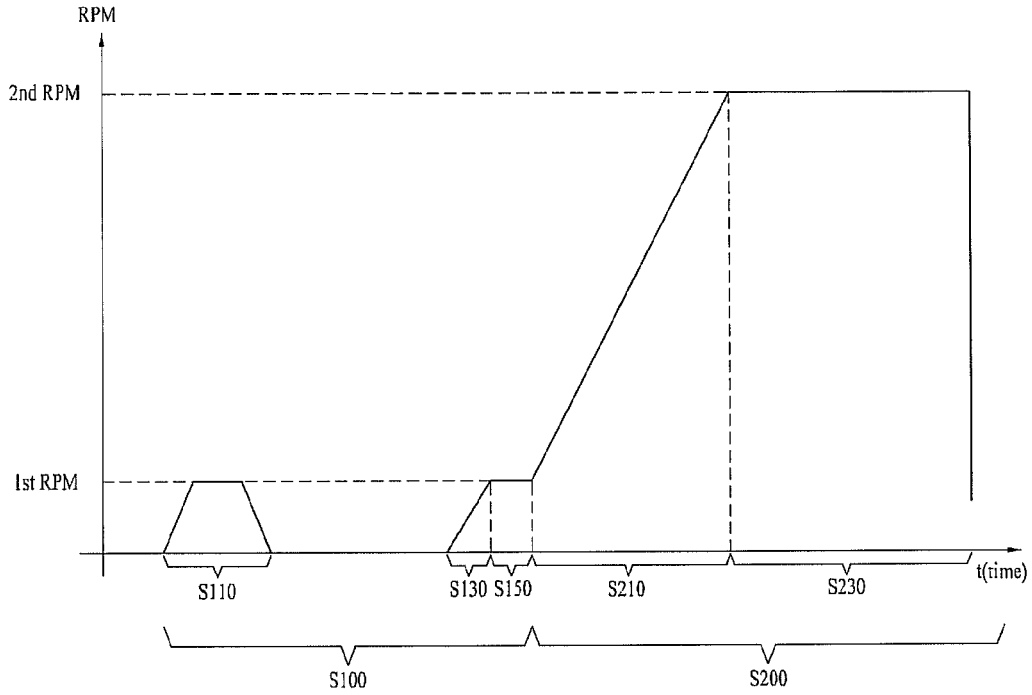
FIG. 4 is a graph illustrating the rotating velocity of a drum in a spin-drying cycle.

FIG. 4 is a graph illustrating change of RPM of the drum according to time in the spin-drying cycle of the washing machine in accordance with the embodiment. In FIG. 4, the horizontal axis represents time, and the vertical axis represents change of a rotating velocity of the drum 30, i.e., RPM of the drum 30.

With reference to FIG. 4, the spin-drying cycle is generally divided into laundry distribution (operation S100) and spin-drying (operation S200).

In the laundry distribution (operation S100), the drum may be rotated at a relatively low velocity to uniformly distribute laundry within the drum. In the spin-drying (operation S200), the drum may be rotated at a relatively high velocity to remove moisture from the laundry. Such laundry distribution and spin-drying are named based on functions of the respective operations, and the functions of the operations are not limited by such names. For example, even in the laundry distribution, removal of moisture from the laundry due to rotation of the drum as well as distribution of the laundry may be performed. Hereinafter, the respective operations will be described in detail.

When a rinsing cycle has been finished, the laundry within the drum 30 gets wet. If the spin-drying cycle is started, a controller may sense the amount of the laundry within the drum 30, i.e., the amount of the wet laundry within the drum 30 (operation S110).

The reason for sensing the amount of the wet laundry is that, although the amount of laundry which is not wet, i.e., the amount of dry laundry, has been sensed at the initial stage of a washing cycle, the weight of the laundry containing moisture differs from the weight of the dry laundry. The sensed amount of the wet laundry functions as a factor to determine an acceleration allowance requirement to accelerate the drum 30 in excessive region passage operation (operation S210) or to decelerate the drum 30 according to an eccentricity requirement in the excessive region passage (operation S210) to re-execute the laundry distribution operation.

In more detail, the amount of the wet laundry within the drum 30 may be measured if the drum 30 is accelerated at a first rotating velocity (a first RPM), for example, about 100 to 110 RPM, is operated at a regular velocity for a designated time, and is then decelerated. When the drum 30 is decelerated, power generation and brake may be used. The amount of the wet laundry may be sensed using the amount of rotation of the drive motor 40 rotating the drum 30 in an acceleration section, the amount of rotation of the drive motor 40 in a deceleration section, DC power applied to the motor 40, etc.

After the amount of the wet laundry has been sensed, the controller may perform laundry disentanglement to distribute the laundry within the drum 30 (operation S130).

The laundry disentanglement serves to uniformly distribute the laundry within the drum 30 to prevent rising of the amount of eccentricity of the drum 30 due to concentration of the laundry into a specific region within the drum 30. When the amount of eccentricity of the drum 30 is raised, noise and vibration are increased if the RPM of the drum 30 is raised. The laundry disentanglement may be performed until the drum 30 is accelerated in one direction at a designated tilt angle and thus reaches a rotating velocity of an eccentricity sensing operation which will be described later.

Thereafter, the controller may sense eccentricity of the drum 30 (operation 150). As described above, if the laundry within the drum 30 is not uniformly distributed and is concentrated into a designated region within the drum 30, the amount of eccentricity is increased and may cause noise and vibration due to eccentric rotation of the drum 30 when the RPM of the drum 30 is increased. Therefore, the controller may determine whether or not the drum 30 is accelerated by sensing the amount of eccentricity of the drum 30.

In order to sense eccentricity of the drum 30, a difference of accelerations if the drum 30 is rotated may be used. That is, there is a difference of accelerations between the case in that the drum 30 is rotated in the downward direction in conformity with gravity and the case in that the drum 30 is rotated in the upward direction opposite to gravity, according to degrees of eccentricity of the drum 30. The controller may measure an acceleration difference using a velocity sensor, such as a hall sensor provided on the drive motor 40, and may measure the amount of eccentricity using the sensed acceleration difference. Therefore, if eccentricity is sensed, a state in which the laundry within the drum 30 is adhered to the inner wall of the drum 30 even if the drum 30 is rotated should be maintained, for example, in this state, the drum 30 is rotated at a velocity of about 100 to 110 RPM.

When the drum 30 is accelerated at a high velocity if the amount of eccentricity sensed at a designated amount of wet laundry is more than a reference amount of eccentricity, vibration and noise of the drum 30 are greatly increased and thus acceleration of the drum 30 may be difficult. Therefore, the controller may store data in which reference amounts of eccentricity allow acceleration according to amounts of wet laundry, in a table form. Therefore, the controller may sense the amount of eccentricity after sensing the amount of wet laundry, and applies the sensed amount of wet laundry and amount of eccentricity to the table, thereby determining whether or not the drum is accelerated. That is, if the amount of eccentricity according to the sensed amount of wet laundry is more than the reference amount of eccentricity, the amount of eccentricity is excessively high and thus the drum 30 cannot be accelerated. In this case, the above-described wet laundry sensing, laundry disentanglement and eccentricity sensing operations may be repeated.

Such wet laundry sensing, laundry disentanglement and eccentricity sensing operations may be repeated until the sensed amount of eccentricity becomes less than the reference amount of eccentricity. However, if the washing machine is out or order or the laundry within the drum is excessively entangled, the sensed amount of eccentricity is not less than the reference amount of eccentricity and thus the wet laundry sensing, laundry disentanglement and eccentricity sensing operations may be continuously repeated. Therefore, when the wet laundry sensing, laundry disentanglement and eccentricity sensing operations are repeated until a designated time, for example, about 5 to 10 minutes, from starting of the spin-drying cycle, has elapsed, the controller stops rotation of the drum and informs a user that the spin-drying cycle is not normally completed.

If the amount of eccentricity according to the sensed amount of wet laundry is less than the reference amount of eccentricity, the acceleration allowance requirement is satisfied and the subsequent excessive region passage operation (S210) may be performed.

Here, an excessive region may be defined as a region of a designated RPM band including one or more resonance frequencies in which resonance is generated according to a system of the washing machine. The excessive region is an intrinsic vibration characteristic generated according to a system of the washing machine when the system is determined. The excessive region is varied according to the system of the washing machine, and may be in the range of, for example, about 200 to 350 RPM.

That is, if the rotating velocity of the drum 30 passes through the excessive region, resonance of the washing machine occurs and noise and vibration of the washing machine may be greatly increased. Noise and vibration of the washing machine may provide uncomfortableness to the user, and thus disturb acceleration of the drum 30. If the rotating velocity of the drum 30 passes through the excessive region, noise and vibration may be reduced by accelerating the drum 30 by properly adjusting an acceleration gradient.

Due to acceleration of the drum 30 while the rotating velocity of the drum 30 passes through the excessive region, or unexpected impact applied from the outside, the amount of eccentricity of the drum 30 may be increased. When the amount of eccentricity of the drum 30 is increased to be more than a designated value, noise is greatly increased and continuous acceleration of the drum 30 is difficult. Therefore, if the rotating velocity of the drum 30 passes through the excessive region, the controller may continuously sense the amount of eccentricity of the drum 30.

Further, the controller may include a vibration sensor provided on the drum of the washing machine to sense vibration of the drum 30 if the rotating velocity of the drum passes through the excessive region. When vibration and/or the amount of eccentricity of the drum 30 sensed in the excessive region passage operation is more than a designated value, the controller may decelerate the drum 30 and then repeat the above-described wet laundry sensing, laundry disentanglement and eccentricity sensing operations.

After the excessive region passage operation, the controller may perform drainage (operation S230).

The controller removes water from the laundry by maintaining the rotating velocity of the drum 30 to a second RPM (operation S200). In more detail, in the drainage operation, the controller accelerates the drum 30 to a relatively high velocity up to a desired RPM and then maintains the velocity of the drum 30, thereby removing water from the laundry. In this case, the balls of the balancer move to a position opposite to the laundry (hereinafter, referred to as an 'eccentricity coping position') to reduce the amount of eccentricity of the drum 30, thereby reducing vibration and noise due to rotation of the drum 30.

In the balancer having the above-described configuration, the balls 80 move according to rotation of the drum 30, and when the rotating velocity of the drum 30 reaches a designated RPM, the balls 80 are located at the eccentricity coping position. However, in the above-mentioned balancer, it is difficult to arbitrarily determine the position of the balls 80, and the balls 80 do not actively move but move according to rotation of the drum 30. Therefore, when the drum 30 is rotated, the balls 80 may not properly move to the eccentricity coping position or may not effectively move due to external influence.

Particularly, many users recently desire to treat a large amount of laundry to be washed at a time, and in order to meet such a trend, the capacity of the washing machine, i.e., the maximum amount of laundry which can be into the washing machine increases. As the maximum amount of laundry which can be into the washing machine increases, the amount of eccentricity may increase even if the laundry is entangled, and thus the overall weight of the balls of the balancer needs to be increased. In order to increase the weight of the balls, there is a method of increasing the sizes of the balls to increase the weights of the respective balls, or a method of increasing the total number of the balls.

When the weights of the respective balls are increased, movement of the balls according to rotation of the drum is not smooth and thus it may be difficult for the balls to properly move to the eccentricity coping position. Further, when the number of the balls is increased, the balls may be concentrated into a region other than the eccentricity coping position if the rotating velocity of the drum passes through the above-described excessive region. When the balls are concentrated into the region other than the eccentricity coping position, the weight of the balls may act as another amount of eccentricity of the drum to increase the total amount of eccentricity of the drum and thus increase noise and vibration according to rotation of the drum. Hereinafter, in order to solve the above problem, configurations of balancers in accordance with other embodiments will be described, and then control methods of such balancers will be described.

The balancers which will be described below may arbitrarily determine the position of balls when the drum is rotated, or may actively the balls regardless of rotation of the drum. Hereinafter, the balancers in accordance with various embodiments will be described with reference to the drawings.

Figure 5:
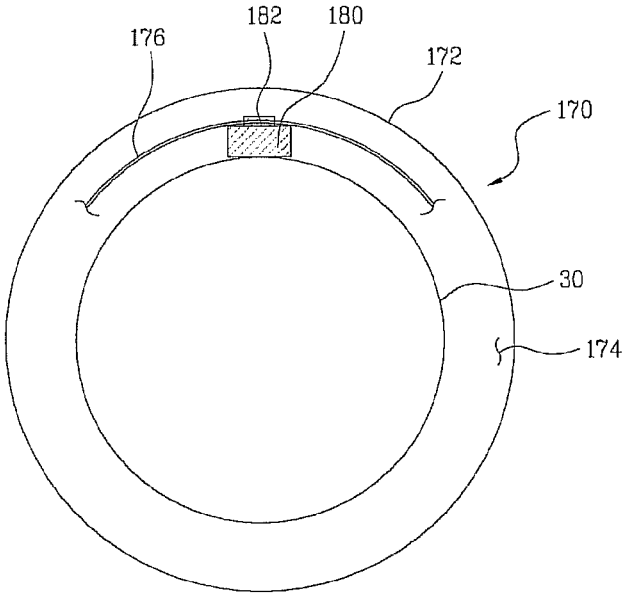
FIGS. 5 to 9 are schematic views illustrating balancers in accordance with various embodiments.

FIG. 5 is a schematic view illustrating the configuration of a balancer in accordance with another embodiment.

With reference to FIG. 5, a balancer 170 may include a housing 172 provided along the outer circumference of the drum 30. The housing 172 may include a path 174 in which a balancing unit 180 moves. The balancing unit 180 is movable along the path 174, for example, is movable along a guide unit 176 provided along the path 174. The guide unit 176 may be provided in a form similar to, for example, an LM guide. Further, a stopper 182 fixing the balancing unit 180 when the balancing unit 180 reaches a desired position may be provided.

That is, when the drum 30 is rotated, the balancing unit 180 moves along the guide unit 176, and when the balancing unit 180 reaches a desired position, the balancing unit 180 is fixed to the guide unit 176 by driving the stopper 182 so as to prevent the balancing unit 180 from moving any more. Here, 'the desired position' may be variously set. For example, if the balancing unit 180 is rotated along the guide unit 176 according to rotation of the drum 30, the controller may continuously sense the amount of eccentricity to set a position where the amount of eccentricity is minimized as the desired position. On the other hand, when the drum 30 is not rotated, the balancing unit 180 may be located at the lower portion of the drum by the self weight of the balancing unit 180.

Figure 6:
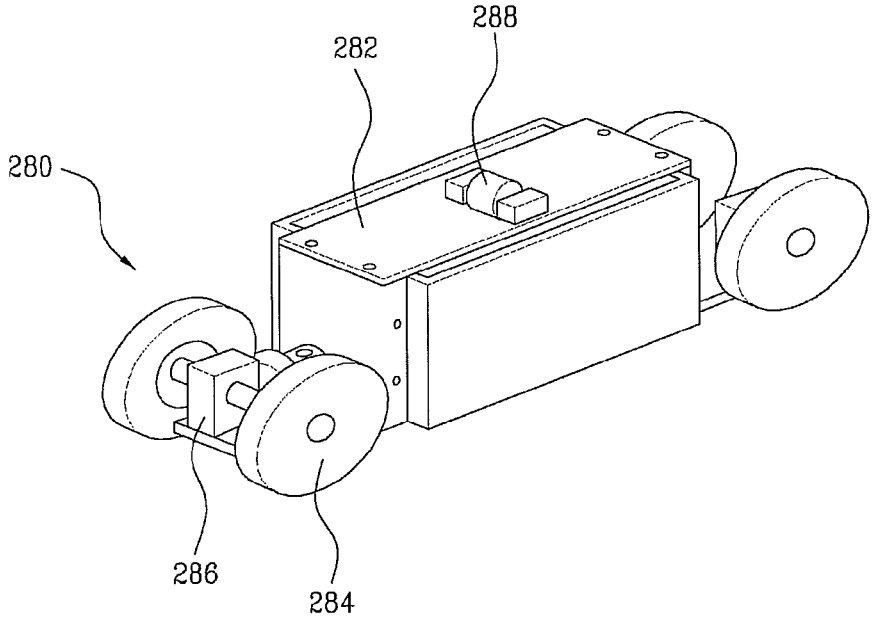

FIG. 6 is a perspective view illustrating the configuration of a balancer in accordance with another embodiment. In FIG. 6, a housing provided along the outer circumference of the drum and providing a path in which a balancing unit moves is not illustrated, but only the balancing unit is illustrated, for convenience.

With reference to FIG. 6, a balancing unit 280 may include a body 282. The body 282 may have a proper weight so as to serve as a mass body. Further, the body 282 may include wheels 284 at designated positions to move the body 282, and motor 286 to provide driving force to rotate the wheels 284. Whether or not the motors 286 drive may be determined by the controller of the washing machine.

However, although the motors 286 drive to rotate the wheels 284, it may be difficult for the balancing unit 280 to move along the inside of the housing. For example, if frictional force between the wheels 284 and the inner surface of the housing is smaller than the self weight of the balancing unit 280 even when the wheels 284 are rotated, the wheels 284 are idled and thus the balancing unit 280 may slide toward the lower portion of the drum. Consequently, in order to move the balancing unit 280, the frictional force between the wheels 284 and the inner surface of the housing needs to be increased in consideration of the self weight of the balancing unit 280. For this purpose, the wheels 284 may be formed of a material having remarkably great frictional force.

Otherwise, an environment allowing the balancing unit 280 to move according to rotation of the drum may be provided. That is, when the drum is rotated, centrifugal force is applied outwards in the radial direction of the drum, and the centrifugal force is applied perpendicularly to the balancing unit 280 and thus copes with a kind of normal force. Therefore, the frictional force between the balancing unit 280 and the housing is increased by the centrifugal force, and as the rotation of the drum is accelerated, the centrifugal force is increased and the frictional force between the balancing unit 280 and the housing is increased. Consequently, when the rotating velocity of the drum is more than a designated RPM, the frictional force between the balancing unit 280 and the housing is sufficiently increased and thus the balancing unit 280 may move by means of rotation of the wheels 284. Therefore, when the rotating velocity of the drum 30 is increased to be more than the designated RPM, the controller drives motors 286 to move the balancing unit 280. Here, the designated RPM may be defined as RPM at which the frictional force between the balancing unit 280 and the housing is sufficiently increased and the balancing unit 280 moves by means or rotation of the wheels 284. On the other hand, when the drum 30 is not rotated, the balancing unit 280 may be located at the lower position of the drum due to the self weight of the balancing unit 280.

An auxiliary wheel 288 facilitating movement of the balancing unit 280 may be further provided on the upper portion of the body 282. If there is no auxiliary wheel 288, the upper portion of the body 282 contacts the inner surface of the housing when the balancing unit 280 moves, and may disturb movement of the balancing unit 280. Therefore, in order to prevent disturbance of movement of the balancing unit 280, the auxiliary wheel 288 may be further provided on the upper portion of the body 282.

Figure 7:
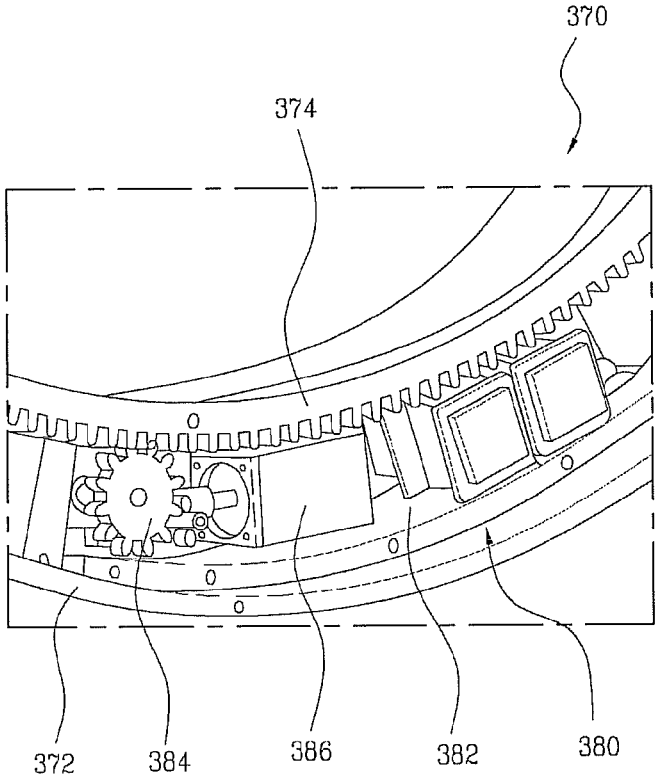

FIG. 7 is a schematic view illustrating the configuration of a balancer in accordance with another embodiment.

With reference to FIG. 7, a balancer 370 in accordance with this embodiment may include a housing 372 provided along the outer circumference of the drum 30. The balancer 370 may further include a rack 374 provided along the inside of the housing 372, and a balancing unit 380 movable along the inside of the housing 372 and including a pinion 384 corresponding to the rack 374. The balancing unit 380 may further include a body 382 and a motor 386 installed in the body 382 to provide driving force to rotate the pinion 384. Whether or not the motor 386 drives may be determined by a signal from the controller.

Therefore, the motor 386 may drive by means of the signal from the controller to rotate the pinion 384, and the balancing unit 380 may move along the rack 374 according to rotation of the pinion 384 engaged with the rack 374. If the pinion 384 is freely movable without restriction, when the drum is not rotated, the balancing unit 380 may be located at the lower portion of the drum due to the self weight of the balancing unit 380. On the other hand, if rotation of the pinion 384 is restricted by increasing a reduction ratio of the motor 386 to which the pinion 384 is connected, the balancing unit 380 is fixed to a designated position of the rack 374 and is rotated in connection with rotation of the drum 30 when the motor 386 does not drive.

Figure 8:
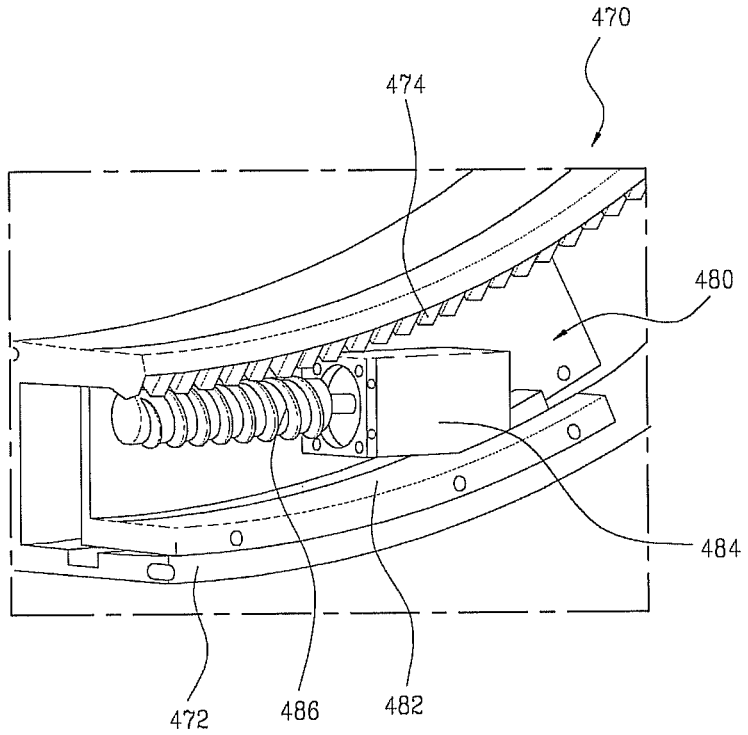

FIG. 8 is a schematic view illustrating the configuration of a balancer in accordance with another embodiment.

With reference to FIG. 8, a balancer 470 in accordance with this embodiment may include a housing 472 provided along the outer circumference of the drum 30. The balancer 470 may further include a worm wheel 474 provided along the inside of the housing 472, and a balancing unit 480 movable along the inside of the housing 472 and including a worm gear 486 corresponding to the worm wheel 474. The balancing unit 480 may further include a body 482 and a motor 484 provided on the body 482 to provide driving force to rotate the worm gear 486. Whether or not the motor 484 drives may be determined by a signal from the controller.

Therefore, the motor 484 drives by means of the signal from the controller to rotate the worm gear 486, and the balancing unit 480 may move along the worm wheel 474 according to rotation of the worm gear 486 engaged with the worm wheel 474. On the other hand, when the drum is not rotated, the worm gear 486 is not rotated and is restricted by the worm wheel 474. Therefore, the balancing unit 480 is fixed to a designated position of the worm wheel 474 and is rotated in connection with rotation of the drum 30 when the motor 484 does not drive.

Figure 9:
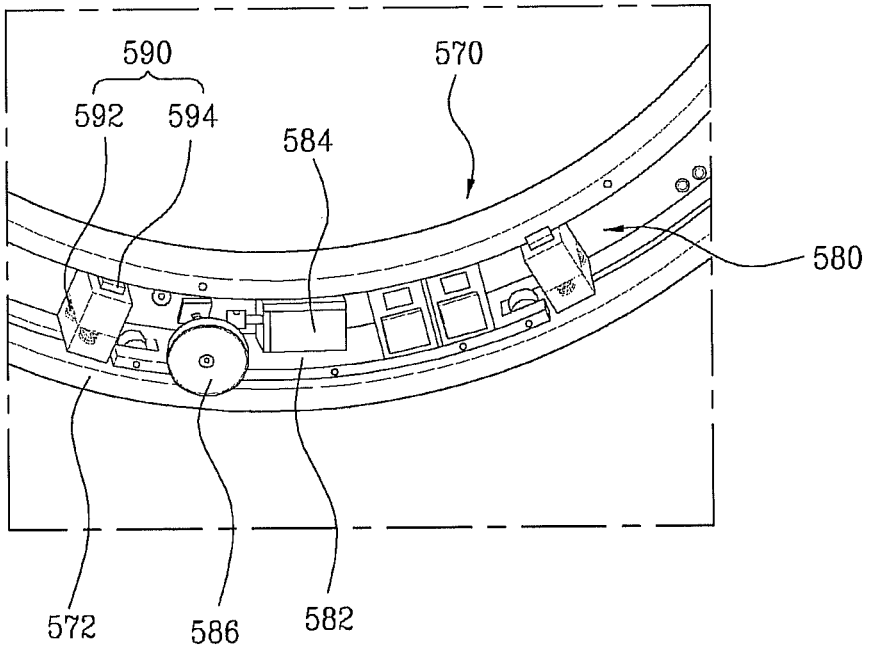

FIG. 9 is a schematic view illustrating a balancer in accordance with another embodiment.

With reference to FIG. 9, a balancer 570 in accordance with this embodiment may include a housing 572 provided along the outer circumference of the drum 30. The balancer 570 may further include a body 582 provided within the housing 572, a wheel 586 provided at a designated position of the body 582 and selectively movable by driving of a motor 584, and a brake unit 590 to prevent movement of the body 582 in a condition of less than a third designated RPM.

The motor 584 drives by means of a signal from the controller, and the wheel 586 is rotated by driving of the motor 584 to move body 582. If the wheel 586 is rotated, it may be difficult for the balancing unit 580 to move along the inside of the housing 572. For example, if frictional force between the wheel 586 and the inner surface of the housing is smaller than the self weight of the balancing unit 250 even when the wheel 586 is rotated, the wheel 596 may be idled. Consequently, in order to move the balancing unit 580, the frictional force between the wheel 586 and the inner surface of the housing needs to be increased in consideration of the self weight of the balancing unit 580. For this purpose, the wheel 586 may be formed of a material having remarkably great frictional force. Otherwise, an environment allowing the balancing unit 580 to move according to rotation of the drum may be provided. That is, when the drum is rotated, centrifugal force is applied outwards in the radial direction of the drum, and the centrifugal force is applied to the inner surface of the housing perpendicularly to the balancing unit 580. Therefore, the frictional force between the balancing unit 580 and the housing occurs by the centrifugal force, and as the rotation of the drum is accelerated, the centrifugal force is increased and thus the frictional force between the balancing unit 580 and the housing is increased. Consequently, when the rotating velocity of the drum is more than a fourth designated RPM, the frictional force between the balancing unit 580 and the housing is sufficiently increased and thus the balancing unit 580 may move by means of rotation of the wheel 586. Therefore, when the rotating velocity of the drum 30 is raised to be more than the fourth designated RPM, the controller may drive the motor 584 to move the balancing unit 580.

On the other hand, when the drum 30 is not rotated, the balancing unit 580 may be fixed to a designated position of the housing 572 so as to reduce vibration. Therefore, the balancing unit 580 in accordance with this embodiment may include a brake unit 580 to prevent movement of the body 582 in a condition of less than the third designated RPM. The brake unit 590 may include elastic members 592 providing elastic force in the opposite direction to centrifugal force, and a stopper 594 to which the elastic force of the elastic members 592 is applied.

Therefore, when the elastic members 592 provide elastic force in the opposite direction to centrifugal force, i.e., toward the drum, the stopper 594 protrudes and contacts the inner surface of housing, thus preventing movement of the body 582. On the other hand, when the drum 30 is rotated, centrifugal force is applied outwards in the radial direction of the drum 30. When the rotating velocity of the drum is more than the third designated RPM, the centrifugal force may become greater than the elastic force of the elastic members 592. Therefore, the stopper 594 moves toward the outside of the drum by centrifugal force, contact between the stopper 594 and the inner surface of the housing 572 is eliminated, and the body 582 becomes in a movable state. Although the above-described third RPM and fourth RPM in this embodiment are set to similar values, the third RPM and the fourth RPM are not limited thereto.

In the above-described embodiments, if the balancing unit moves relative to the drum 30, a drive source, such as a motor to move the balancing unit, may be provided. Such a drive source is driven by electric force, and may thus require a power supply source to supply power. Such a power supply source in a battery type may be directly provided on the balancing unit. However, if the power supply source is directly provided on the balancing unit, the washing machine and the balancer need to be disassembled to replace the battery with a new one if the battery is discharged as well as the configuration of the balancing unit becomes complicated. Therefore, a wireless charging device to charge the balancing unit wirelessly will be described below with reference to the drawings.

Figure 10:
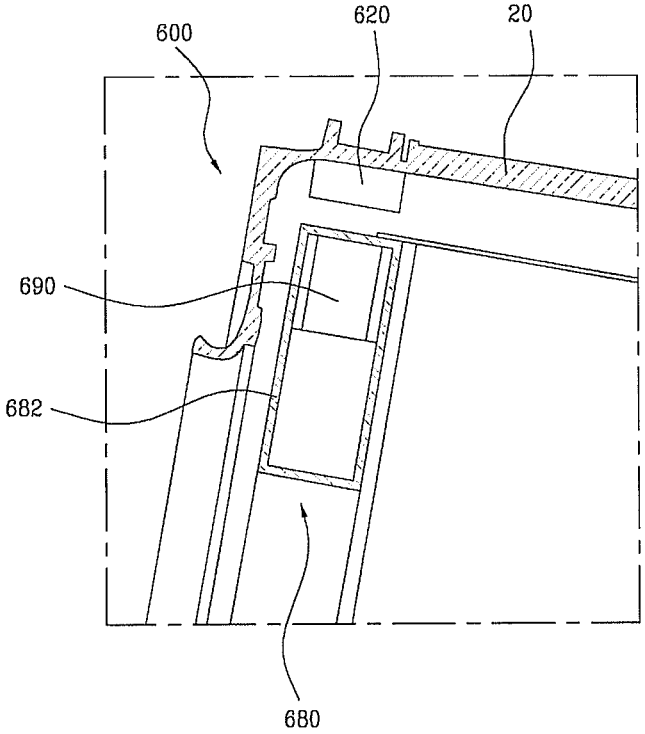
FIGS. 10 and 11 are schematic views illustrating wireless charging devices in accordance with various embodiments.

FIG. 10 is a schematic view illustrating a wireless charging device in accordance with one embodiment.

With reference to FIG. 10, a wireless charging device 600 may include magnets 620 provided at designated positions of the tub 20 and solenoids 690 corresponding to the magnets 620 and provided on a balancing unit 680. Therefore, if the balancing unit 680 is rotated, a condenser (a capacitor; not shown) of the balancing unit 680 may be charged through the solenoids 690 by electromagnetic induction between the solenoids 690 and the magnets 620 provided on the tub 20. In this case, since the magnets 620 are provided on the tub 20 which is not rotated, the condenser may be charged by rotating the balancing unit 680. In order to rotate the balancing unit 680, the balancing unit 680 is fixed to a designated position along a balancer housing 682 and the drum is rotated. Thereby, the balancing unit 680 may be rotated together with the drum 30.

Although not shown in the drawings, a first coil and a second soil may substitute for the above-described magnet and solenoid. That is, if the balancing unit is rotated, the balancing unit may be charged by electromagnetic induction between the first coil provided on the tub and the second coil of the balancing unit. This case is similar to the description of FIG. 10 except for substitution of the first coil and the second coil for the magnet and the solenoid of the wireless charging device, and a repeated description thereof will thus be omitted.

Figure 11:
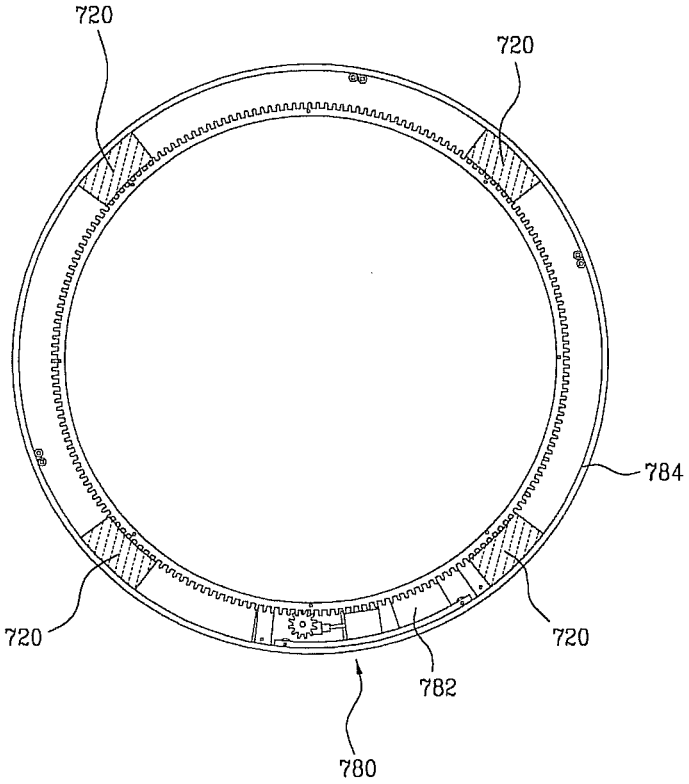

FIG. 11 is a schematic view illustrating a wireless charging device in accordance with another embodiment.

With reference to FIG. 11, a wireless charging device 700 includes magnets 720 provided at designated positions of the drum 30 or a balancer housing 784, and solenoids 782 corresponding to the magnets 720 and provided on a balancing unit 780. That is, the wireless charging device in accordance with this embodiment differs from the wireless charging device in accordance with the above-described embodiment of FIG. 10 in that the magnets 720 are provided on the drum or the balancer housing which is rotated.

Although FIG. 11 illustrates a balancer including a rack provided in the housing and a pinion provided on the balancing unit for convenience, the present invention is not limited thereto. Therefore, a condenser (a capacitor) of the balancing unit 780 may be charged through the solenoids 782 by electromagnetic induction between the solenoids 782 and the magnets 720.

Figure 12:
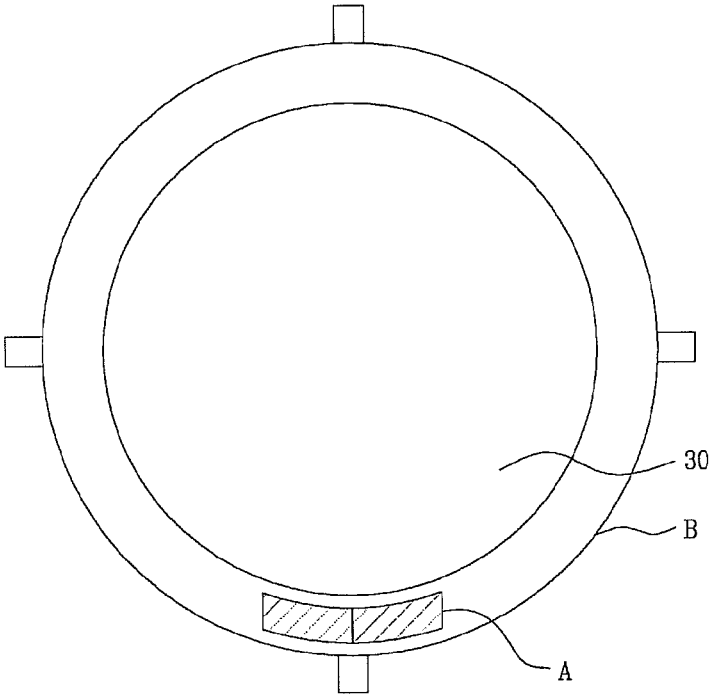
FIG. 12 is a schematic view illustrating the position of balancing units in the wireless charging device of FIG. 11.

In this case, since the magnets 720 are provided on the drum 30 or the balancer housing 784 which is rotated, when the drum 30 is rotated, in order to generate relative movement between the magnets 720 and the solenoids 782, the balancing unit 780 is preferably fixed to a designated position without rotation even if the drum 30 is rotated. For example, the balancing unit A in accordance with each of the above-described embodiments shown of FIGS. 5, 6 and 7, when the stopper or the motor is not driven, is located at the lower portion of the drum 30 due to the self weight of the balancing unit A without movement even if the drum 30 is rotated, as shown in FIG. 12. Therefore, when the balancing unit A is located at the lower portion of the drum 30 without movement and the drum 30 and the housing B are rotated, relative moment between the balancing unit A and the drum 30 occurs and thus electromagnetic induction between the solenoids and the magnets may be generated.

Although not shown in the drawings, a first coil and a second soil may substitute for the above-described magnet and solenoid. That is, the balancing unit may be charged by electromagnetic induction between the first coil and the second coil. This case is similar to the description of FIG. 11 except for substitution of the first coil and the second coil for the magnet and the solenoid of the wireless charging device, and a repeated description thereof will thus be omitted.

Although the balancer in accordance with each of the above-described embodiments is illustrated as including one balancing unit, the balancer may include two or more balancing units. Particularly, the amount of dry laundry or the amount of wet laundry may be sensed using the amount of rotation due to rotation in the acceleration section according to rotation of the drum, the amount of rotation in the deceleration section, DC power applied to the motor, etc. However, if one balancing unit is provided, the weight of the balancing unit may act as the amount of eccentricity when the weight of the laundry is sensed. Therefore, when the drum is rotated, the weight of the balancing unit influences the amount of rotation, and thus it may be difficult to precisely sense the weight of the laundry. In order to solve such a problem, two or more balancing units may be provided. For example, if two balancing units are provided, increase of the amount of eccentricity due to the balancing units may be prevented by identically maintaining a phase difference between the balancing units (i.e., maintaining the phase difference of 180° between the two balancing units). Therefore, the weight of the laundry may be precisely sensed.

Hereinafter, a control method of the balancer in accordance with each of the above-described embodiments of FIGS. 5 to 11 will be described.

Figure 13:
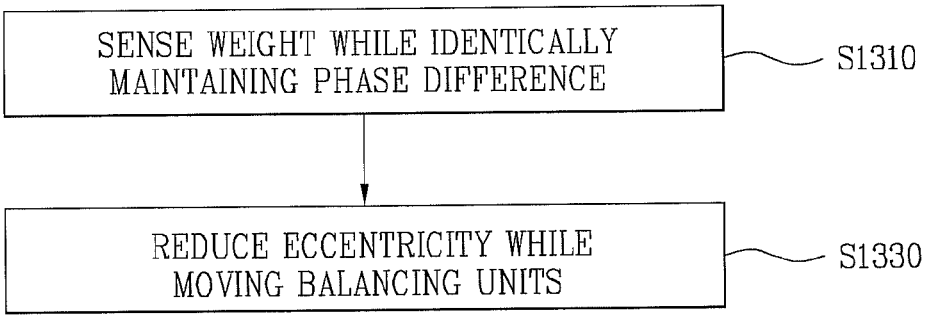
FIG. 13 is a flowcharts illustrating a control method of a washing machine in accordance with one embodiment.

FIG. 13 is a flowchart illustrating a control method of a balancer in accordance with one embodiment.

With reference to FIG. 13, the control method in accordance with this embodiment include sensing the weight of laundry to be washed while identically maintaining a phase difference between two or more balancing units (operation S1310) and reducing eccentricity while moving the balancing units (operation 1330).

The sensing of the weight of the laundry (operation S1310) may be performed in at least one of the washing cycle, the rinsing cycle and the spin-drying cycle. For example, the sensing of the weight of the laundry (operation S1310) may be performed if the amount of laundry which is not wet (the amount of dry laundry) is sensed at the initial stage of the washing cycle, if the amount of laundry which is wet (the amount of wet laundry) is sensed at the initial stage of the rinsing cycle, or if the amount of laundry which is wet (the amount of wet laundry) is sensed at the initial stage of the spin-drying cycle.

In more detail, if the amount of dry laundry or the amount of wet laundry is sensed, the amount of dry laundry or the amount of wet laundry is sensed using the amount of rotation according to rotation of the drum in the acceleration section, the amount of rotation in the deceleration section, DC power applied to the motor, etc. However, if one balancing unit is provided, the weight of the balancing unit acts as the amount of eccentricity when the weight of the laundry is sensed. Therefore, when the drum is rotated, the weight of the balancing unit influences the amount of rotation, and thus it may be difficult to precisely sense the weight of the laundry. In order to solve such a problem, one or more balancing units may be provided.

For example, if two balancing units are provided, the amount of eccentricity generated from the balancing units may be reduced by identically maintaining a phase difference between the balancing units (i.e., maintaining the phase difference of 180° between the two balancing units). That is, when the balancing units are rotated in connection with the drum while identically maintaining the phase difference between the balancing units, the weight of the laundry may be precisely sensed. If three or more balancing units are provided, increase of the amount of eccentricity due to the weight of the balancing units may be prevented by identically maintaining phase differences between the respective balancing units. In this case, the balancing units may be rotated in connection with the drum.

Figure 14:
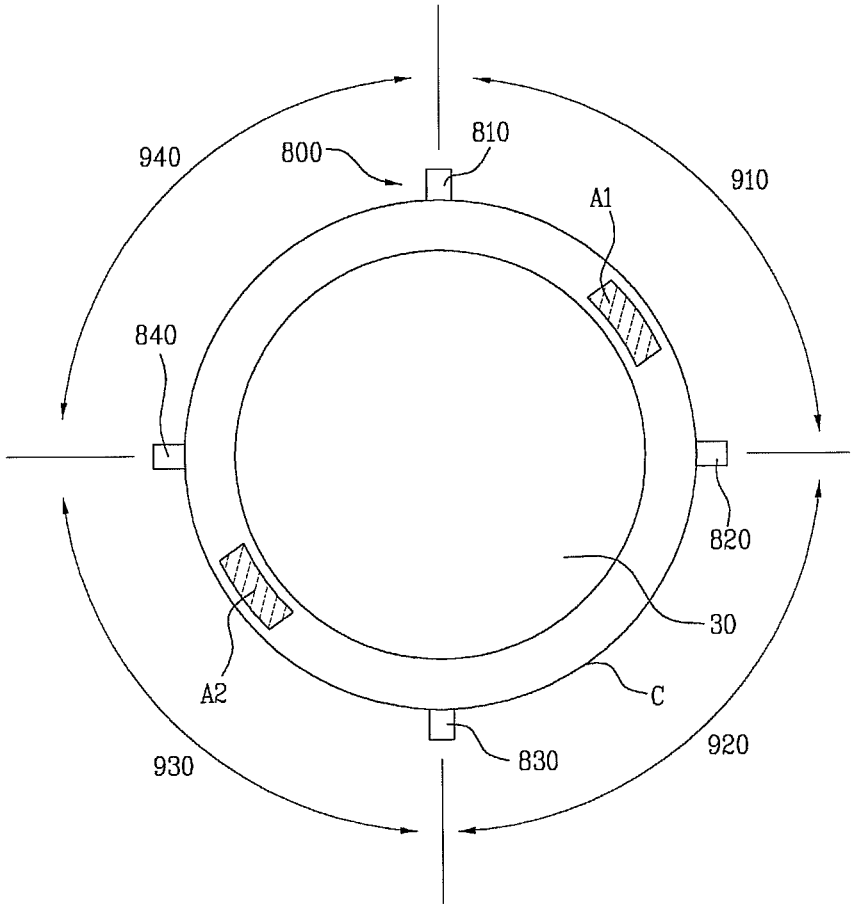
FIG. 14 is a schematic view of a washing machine having phase sensing devices.

In order to identically maintain a phase difference between two or more balancing units, phase sensing devices to sense phases the balancing units may be provided. FIG. 14 schematically illustrates the configuration of a washing machine having phase sensing devices.

With reference to FIG. 14, phase sensing devices 800 may be provided at designated positions of a housing C including a path along which balancing units A1 and A2 move. Two or more phase sensing devices 800 may be provided. Although FIG. 14 illustrates four phase sensing devices 800 provided along the outer circumference of the drum 30, the number of the phase sensing devices 800 is not limited thereto. For example, in order to precisely sense phases of the balancing units A1 and A2 along the outer circumferential surface of the drum, a larger number of phase sensing devices 800 may be provided.

If a first phase sensor 810, a second phase sensor 820, a third phase sensor 830 and a fourth phase sensor 840 are provided, as shown in FIG. 14, a phase difference between the balancing units A1 and A2 may be adjusted. Here, the phase sensors may be, for example, sensors which optically sense movement of the balancing units, or sensors using infrared rays.

For example, the case in that two balancing units A1 and A2 will be described below. For convenience of description, an area between the first phase sensor 810 and the second phase sensor 820 is defined as a first area 910, an area between the second phase sensor 820 and the third phase sensor 830 is defined as a second area 920, an area between the third phase sensor 830 and the fourth phase sensor 840 is defined as a third area 930, and an area between the fourth phase sensor 840 and the first phase sensor 810 is defined as a fourth area 940.

If the balancing units A1 and A2 move along the inside of the housing C, when the first balancing unit A1 is rotated in the clockwise direction and passes through the first phase sensor 810, the first balancing unit A1 is located in the first area 910. In this case, a phase difference between the first balancing unit A1 and the second balancing unit A2 may be identically maintained by adjusting the rotating direction and/or velocity of the second balancing unit A2 so that the second balancing unit A2 is located in the third area 930. If four or more phase sensors are provided, as described above, it is possible to more precisely maintain the phase difference. Therefore, as a larger number of balancing units are provided, installation of a larger number of phase sensors in proportion to the number of the balancing units is advantageous for the balancing units to have the identical phase difference.

Further, with reference to FIG. 13, after the sensing of the weight of the laundry, the reduction of eccentricity of the drum while moving the balancing units may be performed (operation 1330). The reduction of eccentricity (operation 1330) may be performed in the spin-drying cycle of the washing machine, and particularly, may be performed in the sensing of eccentricity (operation S150) of FIG. 4. The reason for this is to easily enter a subsequent operation by reducing eccentricity while moving the balancing units in the operation S150.

Figure 15:
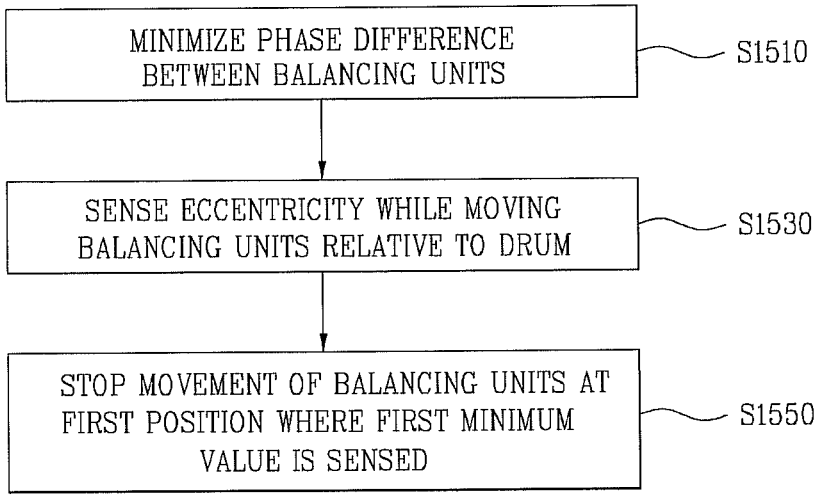
FIGS. 15 and 16 are flowcharts illustrating control methods of a washing machine in accordance with other embodiments.

FIG. 15 is a flowchart illustrating the reduction of eccentricity in more detail.

With reference to FIG. 15, the reduction of eccentricity may include minimizing the phase difference between two or more balancing units (operation S1510). That is, the phase difference between the two or more balancing units may be minimized, for example, the two or more balancing units may be connected, prior to minimization of eccentricity by moving the two or more balancing units. If two or more balancing units are provided, individual movement of the two or more balancing units requires a long time to reduce the amount of eccentricity and causes complexity in reduction of eccentricity.

Further, in order to minimize the phase difference between the two or more balancing units, i.e., to connect the two or more balancing units, distance sensing devices (not shown) to sense a distance between the balancing units may be provided. The distance sensing device may be at least one of a distance sensor (not shown) provided on the balancing unit and generating a signal when the distance between the balancing units is less than a designated distance and a switch (not shown) provided on the balancing unit and generating a signal when the balancing units are connected. Therefore, if the phase difference between the balancing units is desired to be minimized (or the balancing units are desired to be connected), the controller may move the balancing units in the opposite directions, and if the distance sensing device generates a signal, movement of the balancing units is stopped to minimize the phase difference between the balancing units. Further, each of the respective balancing units may be provided with an element to be connected to the opposite balancing unit, i.e., a magnet. Therefore, if a distance between the balancing units is less than a designated distance, the balancing units may be connected by magnetic force between the magnets.

Thereafter, the controller senses eccentricity of the drum 30 while moving the two or more balancing units relative to the drum 30 (operation S1530). That is, if the drum 30 is rotated at a designated RPM, for example, RPM at which the laundry within the drum 30 is adhered to the inner wall of the drum 30 even if the drum 30 is rotated (if the drum 30 is rotated at a velocity of about 100 to 110 RPM), the balancing units moves along the inside of the housing relative to the drum 30. In this case, when the balancing units move approximately to the eccentricity coping position, eccentricity of the drum 30 may be reduced. Therefore, the controller senses eccentricity of the drum 30 according to movement of the balancing units. The method of sensing eccentricity has been described above with reference to FIG. 4, and a detailed description thereof will thus be omitted.

Thereafter, the controller may stop movement of the balancing units at a first position where a first minimum value of eccentricity of the drum 30 is sensed (operation S1550). For example, if the controller senses the minimum value of eccentricity of the drum 30 while the balancing units are rotated once or more (at 360 degrees or more) along the outer circumferential surface of the drum, the controller may store such a minimum value as the first minimum value. Further, the controller may store a position of the balancing units where the first minimum value is sensed as a first position. If the balancing units move under the condition that the phase difference between the balancing units is minimized, i.e., the balancing units are connected, since the first minimum value corresponds to the minimum value of eccentricity, the controller moves the balancing units to the first position and then fix the balancing units at the first position. Here, the first position may be changed by various factors, such as distribution of the laundry within the washing machine, the amount of the laundry, the position of the balancer, etc., and may be nearly the eccentricity coping position.

If two or more balancing units are provided, the amount of eccentricity of the drum may be reduced to be smaller than the first minimum value according to circumstances. That is, since the first minimum value is a sensed value under the condition that the phase difference between the two or more balancing units is minimized (or the two or more balancing units are connected), when the two or more balancing units move from the first position where the first minimum value is sensed, the amount of eccentricity may be reduced to be smaller than the first minimum value.

Figure 16:
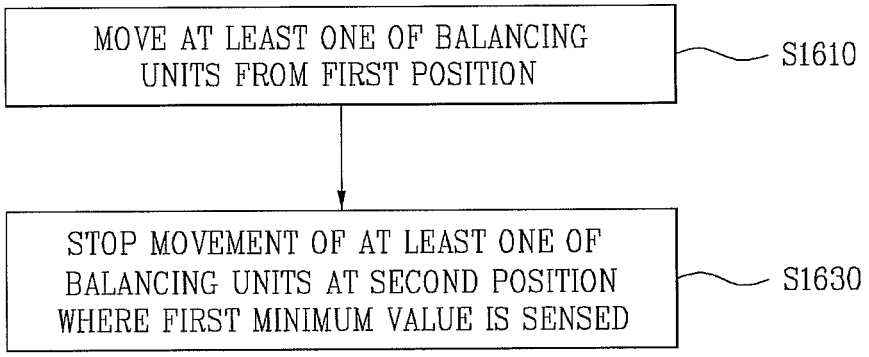

FIG. 16 is a flowchart illustrating operations after the above-described operations of FIG. 15 which are included in reduction of eccentricity in accordance with another embodiment.

With reference to FIG. 16, the reduction of eccentricity in accordance with this embodiment may further include sensing eccentricity while moving at least one of two or more balancing units from the first position (operation S1610), and stopping movement of the at least one of the two or more balancing units at a second position where a second minimum value of eccentricity of the drum is sensed (operation S1630).

The controller may sense eccentricity while moving at least one of two or more balancing units fixed to the above-described first position. Since the embodiment shown in FIG. 15 illustrates the first minimum value of eccentricity as being sensed under the condition that the phase difference between the balancing units is minimized (or the balancing units are connected), in this embodiment, the amount of eccentricity smaller than the first minimum value is searched while moving at least one of the balancing units from the first position. For example, if two balancing units are provided, one of the two balancing units or both of the two balancing units may be moved. Further, if three balancing units are provided, one of the three balancing units may be moved (two of the three balancing units may be stopped), two of the three balancing units may be moved (the balancing unit between the two balancing units may be stopped), or all of the three balancing units may be moved.

If the balancing units are moved, as described above, two or more balancing units may be simultaneously moved. In this case, the controller may properly adjust directions and/or rotating velocities (phases) of the moving balancing units. For example, if two or more balancing units are simultaneously moved, the controller may control movement of the two or more balancing units to the same phase (or at the same velocity) or movement of the two or more balancing units to different phases (or at different velocities). Further, if two or more balancing units are simultaneously moved, the controller may control movement of the two or more balancing units in the opposite directions. The controller may sense the amount of eccentricity while moving the balancing units through such various methods. When a minimum value smaller than the first minimum value is sensed, the controller may store such a minimum value as a second minimum value, store a position of the balancing units where the second minimum value is sensed as the second position, and fix the balancing units to the second position. Thereby, the amount of eccentricity may be reduced to be smaller than the above-described first minimum value.

The reduction of eccentricity may be performed in the spin-drying cycle, as described above. However, when the spin-drying cycle has been completed, most of a course of the washing machine is ended unless a separate drying cycle is performed. Therefore, if the washing course is ended by completion of the spin-drying cycle, the balancing units may be located at the above-described first position or second position. In this case, the phase difference between the balancing units may be minimized (the balancing units may be connected, or the phase difference between the balancing units may be non-identical. Therefore, when a user drives the washing machine again to perform a washing course after a designated time from such a state, the washing machine requires moving the balancing units so as to identically maintain the phase difference between the balancing units to sense the amount of laundry. However, when the washing machine is turned on, it is difficult to move the balancing units if the balancing units are in a discharged state. Therefore, the balancing units are not moved, and the amount of laundry is sensed under the condition that the phase difference between the balancing units is not identical, thereby causing the amount of laundry to be imprecisely sensed. Therefore, the control method in accordance with this embodiment may further include making the phase difference between two or more balancing units to be identical, and such an operation may be performed at the end of the spin-drying cycle.

In order to move the balancing units in the above-described reduction of eccentricity in the above-described reduction of eccentricity, charging the balancing units to move the balancing units may be required. Therefore, the control method in accordance with this embodiment may further include charging the balancing units. The charging of the balancing units may be performed if the drum is rotated, but when the drum is rotated at an excessively high velocity, the above-described wireless charging due to electromagnetic induction is not effectively performed. Therefore, when the charging is performed in the spin-drying stage of the spin-drying cycle in which the drum is rotated at a high velocity of a target RPM, the charging may not be effectively performed. Thus, the charging of the balancing units may be performed in at least one of the washing cycle and the rinsing cycle in which the drum is rotated at a relatively low velocity. Consequently, if the sensing of the weight in FIG. 13 is performed by sensing the amount of dry laundry in the washing cycle, the charging of the balancing units may be performed after the sensing of weight.

If the balancing units are charged, the controller may rotate the drum at a relatively low velocity, for example, about 100 to 120 RPM. However, such velocity is not limited, for example, if the charging of the balancing units is performed in the washing cycle, the rotating velocity of the drum to charge the balancing units may correspond to the rotating velocity of the drum set in the washing cycle. Of course, if the charging of the balancing units is performed in the rinsing cycle, the rotating velocity of the drum to charge the balancing units may correspond to the rotating velocity of the drum set in the rinsing cycle.

If the balancing units are charged, the balancing units are not moved relative to the drum but are preferably fixed to a designated position of the drum and rotated in connection with the drum. When the balancing units are moved relative to the drum, the balancing units use power and thus charging effects are lowered. Further, if two or more balancing units are provided, the balancing units may be charged under the condition that the phase difference between the balancing units is minimized (the balancing units are connected.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A control method of a washing machine including a tub provided within a cabinet, a drum rotatably provided within the tub, and a plurality of balancing units provided on the drum and independently movable relative to the drum by a motor driving the plurality of balancing units, the control method comprising:

sensing the weight of laundry to be washed while rotating a drum and maintaining angles in a circumferential direction of the drum to be identical between the plurality of balancing units while rotating the drum;

moving at least one of the plurality of balancing units simultaneously with rotation of the drum to reduce eccentricity of the drum after sensing the weight of the laundry; and charging a capacitor provided in the plurality of balancing units while rotating the drum.

2. The control method according to claim 1, wherein the charging of the capacitor provided in the plurality of balancing units is performed between the sensing of the weight of the laundry and the moving at least one of the plurality of balancing units.

3. The control method according to claim 1, wherein the sensing of the weight of the laundry is performed in at least one cycle of a washing cycle, a rinsing cycle and a spin-drying cycle.

4. The control method according to claim 1, wherein the charging of the capacitor provided in the plurality of balancing units is performed in at least one cycle of a washing cycle and a rinsing cycle of the washing machine.

5. The control method according to claim 4, wherein, in the sensing of the weight of the laundry and the charging of the capacitor provided in the plurality of balancing units, the plurality of balancing units are rotated in connection with the drum.

6. The control method according to claim 1, wherein, in the charging of the plurality of balancing units, one of the angles between the plurality of balancing units is minimized.

7. The control method according to claim 6, wherein:

the washing machine further includes a housing provided on the drum and providing a path along which the plurality of balancing units move, and a wireless charging device provided at a designated position of the housing; and if the drum and the housing are rotated in the charging of the capacitor provided in the plurality of balancing units, the plurality of balancing units are located at the lower portion of the drum due to the self weight of the plurality of balancing units and are charged.

8. The control method according to claim 1, wherein the moving at least one of the plurality of balancing units is performed in a spin-drying cycle of the washing machine.

9. The control method according to claim 8, wherein the moving at least one of the plurality of balancing units includes maintaining the angles between the plurality of balancing units when the spin-drying cycle has been completed.

10. The control method according to claim 1, wherein, in the moving at least one of the plurality of balancing units, the at least one of the plurality of balancing units is moved relative to the drum.

11. The control method according to claim 10, the moving at least one of the plurality of balancing units includes:

moving the plurality of balancing units for minimizing one of the angles between the plurality of balancing units;

sensing eccentricity of the drum while moving the at least one of the plurality of balancing units relative to the drum;

stopping movement of the at least one of the plurality of balancing units at a first position where a first minimum value of eccentricity of the drum is sensed, wherein the first minimum value of eccentricity is sensed while the at least one of the plurality of balancing units rotates along an outer circumferential surface of the drum.

12. The control method according to claim 11, further comprising:

sensing eccentricity of the drum while moving the at least one of the plurality of balancing units from the first position; and stopping movement of the at least one of the plurality of balancing units at a second position where a second minimum value of eccentricity of the drum smaller than the first minimum value is sensed, wherein the second minimum value of eccentricity is sensed while the at least one of the plurality of balancing units rotates along an outer circumferential surface of the drum.

13. The control method according to claim 12, wherein, the plurality of balancing units are respectively moved in a same direction.

14. The control method according to claim 13, the plurality of balancing units are moved in opposite directions.

15. The control method according to claim 1, wherein the plurality of balancing units includes a pair of balancers, and an angle between the balances of the pair is 180°.

* * * * *